United States Patent [19]

Guerra

[11] Patent Number: 4,595,354

[45] Date of Patent: Jun. 17, 1986

[54] IGNITER FOR GAS DISCHARGE PIPE WITH A FLAME DETECTION SYSTEM

[76] Inventor: Romeo E. Guerra, 6118 Walnut Hill La., Dallas, Tex. 75234

[21] Appl. No.: 743,428

[22] Filed: Jun. 11, 1985

[51] Int. Cl.[4] ..... F23Q 3/00

[52] U.S. Cl. ..... 431/264; 431/266; 431/25; 340/579

[58] Field of Search ..... 431/264, 265, 266, 25, 431/116, 191, 193, 158, 285, 202; 60/39.827; 340/579

[56] References Cited

U.S. PATENT DOCUMENTS

| | | | |
|---|---|---|---|
| 3,136,353 | 6/1964 | Lloyd | 158/28 |
| 3,304,988 | 2/1967 | Rackley | 431/264 X |
| 3,536,428 | 10/1970 | Beesch | 431/264 |
| 4,147,498 | 4/1979 | Clarke | 431/202 |
| 4,406,615 | 9/1983 | Guerra et al. | 431/278 |
| 4,406,616 | 9/1983 | Miyanaka et al. | 361/253 |
| 4,488,537 | 12/1984 | Laurent | 431/264 |
| 4,518,348 | 5/1985 | Wedge et al. | 431/264 X |

*Primary Examiner*—Randall L. Green
*Attorney, Agent, or Firm*—James E. Bradley

[57] ABSTRACT

An igniter for igniting waste gas discharged from a gas discharge pipe has a flame detection circuit. The igniter has an electrode and a gas conduit which supplies a source of fuel to the nozzle for creating a flame to discharge across the gas discharge pipe. A continuous DC voltage is supplied to the electrode, with any current flow between the electrode and the housing indicating the presence of a flame. Passages are provided near the electrode for circulating hot gas to reduce moisture, which could provide false readings. The internal components are mounted on a frame, which is secured in place by a locking device located at the bottom of the housing. The nozzle has a plurality of slots for the discharge of flame with the slots located at the lower end of the nozzle being of larger surface area than at the other end of the nozzle. Auxillary lines extend through the housing for discharging low volume waste gas and flame extinguishing fluid, if desired.

6 Claims, 5 Drawing Figures

IGNITER FOR GAS DISCHARGE PIPE WITH A FLAME DETECTION SYSTEM

BACKGROUND OF THE INVENTION

1. Field of the Invention

This invention relates in general to devices for igniting a gas, and in particular to an igniter having an electrical sparking device for creating a flame, which is discharged across a flare pipe or stack to ignite the wasted gas being discharged from the pipe or stack.

2. Description of the Prior Art

An igniter of the type concerned herein is a device that is mounted near the discharge end of a vertical or horizontal flare pipe or stack. The igniter has a tubular housing with a gas line running through it which terminates in a nozzle. An electrical spark means is located near the nozzle. A source of gas is supplied to the fuel line, which is ignited by the igniter, to direct a flame across the open end of the discharge pipe. The flame ignites the gas being discharged.

Often, the gas being discharged is of low pressure and intermittent in its flow rate. Wind or an interruption of supply, may cause the combustion of the flare gas to cease. Because of these possibilities, it is important that the igniter have a flame continuously present. However, the supply to the igniter may be intermittent as well. On very high stacks, it is hard to see whether or not the igniter flame is ignited, particularly during daytime. One method used to remedy the possibility of the igniter flame going out is to periodically pulse the electrical spark. However, again, one can not be for sure in some cases whether or not the flame is reignited, due to the possibility of poor gas being supplied to the igniter or a malfunction in the igniter.

Another disadvantage of prior igniters is in servicing the igniter. Unbolting the igniter from the stack can be dangerous and time consuming. Removing the inner components from the igniter housing often requires climbing to the top of the housing to loosen bolts and the like.

Another problem encountered in burning waste gas in some types of plants is the need for burning leakage gas. Leakage gas is usually made up of small amounts of gas from various points within a plant, which in themselves may be too small in volume to be conventionally discharged from a stack with larger flow rates. This normally requires a separate low volume stack.

Other improvements in the burning of waste gas are also desirable, including improving the igniter nozzle to further reduce the chance for wind or rain to extinguish the flame.

SUMMARY OF THE INVENTION

The igniter in this invention has the ability to detect whether or not a flame exists at the nozzle. This is done by applying a continuous DC voltage to the electrode. If the flame is present, ionization in the vicinity of the electrode results in a current flow from the electrode to the nozzle housing. If the current stops, this indicates that no flame is present. Humid conditions will also cause a current flow, falsely indicating the present of a flame. To reduce humidity in the vicinity of the electrode, hot gas from the nozzle is circulated around the electrode to remove moisture.

To facilitate the maintenance of the system, the internal components are mounted to a frame that slides into the housing. The frame abuts against a stop member located at the top of the housing. The nozzle is bolted to a shield mounted at the top at the housing. The electrode, which is carried by the frame, inserts into the nozzle as the frame is pushed upwardly. Gas lines carried by the frame telescopingly slide into gas conduits at the nozzle to complete the connection. A locking means at the bottom, presses the frame up against the stop member and locks the frame to the housing at the lower end.

The nozzle has an improved slot configuration to reduce the chances of the flame being extinguished. The nozzle comprises two spaced apart parallel tips, each with a closed end. A plurality of slots are cut into the nozzle tips. Near the bottom and enclosed within the shield, some of the slots are provided with a larger surface area than the other slots. This allows the flame to escape from the bottom. Preferrably, the slots at the bottom have large, circular apertures on one end to provide the additional surface area. There are at least two extra auxillary lines extending through the housing and terminating at the nozzle. One of the auxillary lines may be supplied with leakage gas for continuously allowing the waste gas to be discharged and burned by the igniter itself, rather than discharging the leakage gas through a stack. The other line is supplied with an extinguishing fluid. Should it be necessary to quickly extinguish the flame, the extinguishing fluid flows through the line to be discharged across the stack, extinguishing the flame in the stack and the igniter.

DESCRIPTION OF THE PREFERRED EMBODIMENT

Figure 1:
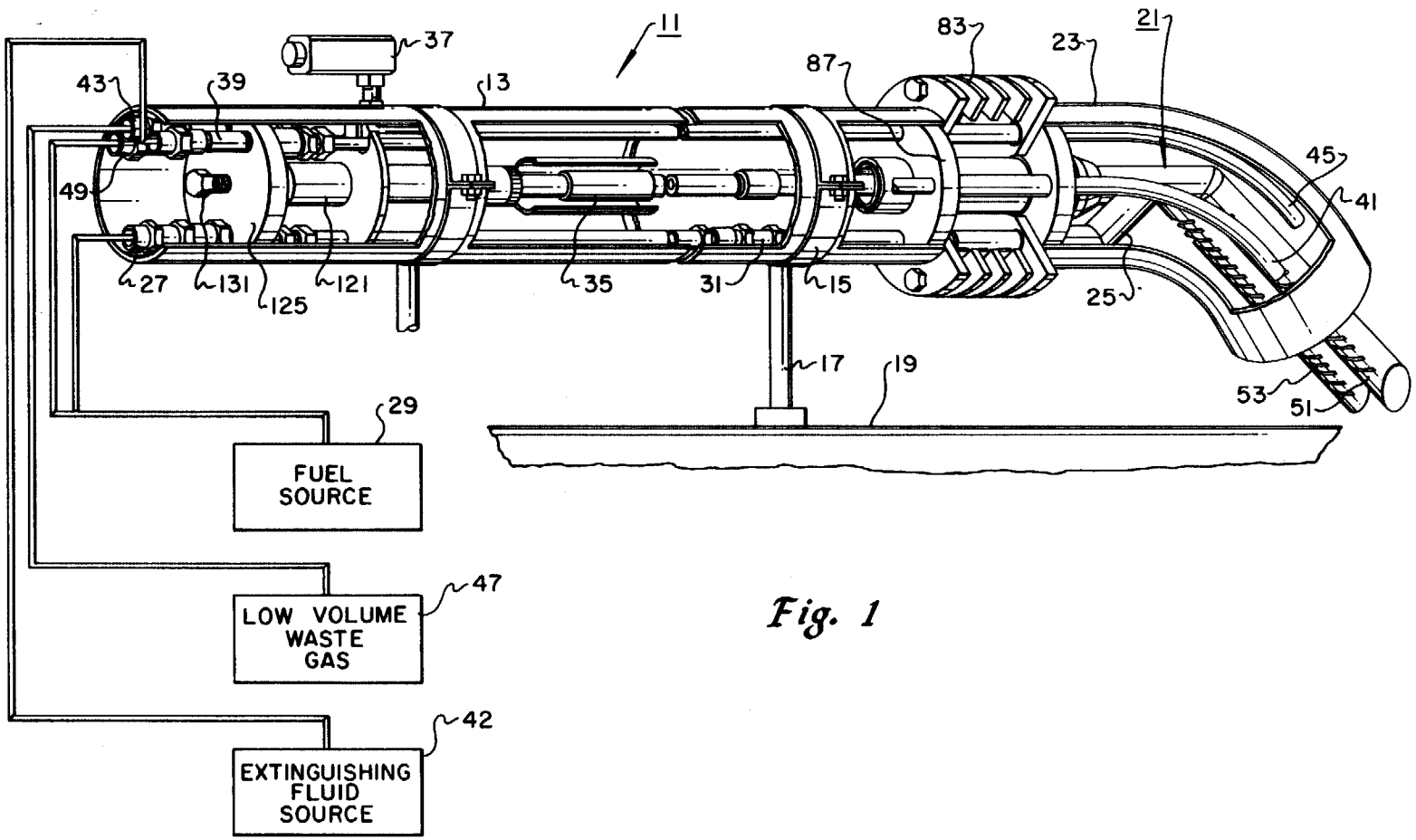
FIG. 1 is a partial side view, with portions broken away, and portions not shown, of an igniter constructed in accordance with this invention.

Referring to FIG. 1, igniter 11 has a tubular housing 13. Housing 13 is secured by clamps 15. Each clamp 15 has a leg 17 that may be welded or bolted to a gas discharge pipe 19. The gas discharge 19 may be horizontal or vertical.

Igniter 11 has a nozzle assembly 21 located at the downstream end, which will be referred to as the upper end. The nozzle assembly 21 is located within a curved tubular shield 23. Shield 23 forms the upper end of the housing 13. A main gas conduit 25 is connected to the nozzle assembly 21. Gas conduit 25 is connected to a main gas line 27 that extends completely the length of the housing 13. The main gas line 27 is connected to a fuel source 29, which may be of various types of gaseous fuel. An orifice 31 located within the housing 13 near the upper end, allows air to be mixed with the gas in the main gas conduit 25. The air is drawn in from the lower end of housing 13, with the upper end being sealed.

An electrode 33 (FIG. 2) is located in the nozzle assembly 21 near the connection with the main gas conduit 25. Electrode 33 is a long steel rod with a tip that is positioned a short distance from the wall of the nozzle assembly 21. When supplied with high electrical voltage from a piezoelectric power source 35 (FIG. 1), a spark will occur between the electrode 33 and the housing of the nozzle assembly 21. The power source 35 is provided with electricity from an electrical hook up 37.

Referring to FIG. 1, a first auxillary line 39 extends completely through the housing 13, and has an open upper end 41 terminating near the top of the shield 23. Auxillary line 39 may be supplied with an extinguishing fluid 42 of a type that will extinguish the flame if desired. A second auxillary line 43 is parallel with the first auxillary 39, extending completely through the housing 13 and terminating with the upper end 45 at nozzle assembly 21. In the embodiment shown, the second auxillary line is connected to a waste gas source 47 that is of a lower flow rate or volume than the waste gas that is being supplied to the gas discharge pipe 19. A third auxillary line 49 is parallel to the first and second auxillary lines 39 and 43. It has an upper end 50 (FIG. 2), terminating at the same point as the upper ends of the first and second auxillary lines 39 and 43. The third auxillary line 49 is supplied with the same gas as the fuel source 29. It does not mix with air however, prior to reaching the mozzle 21, and is used to provide coloration for the flame. The coloration facilitates personnel on the ground determining whether or not a flame is present.

Figures 2, 5:
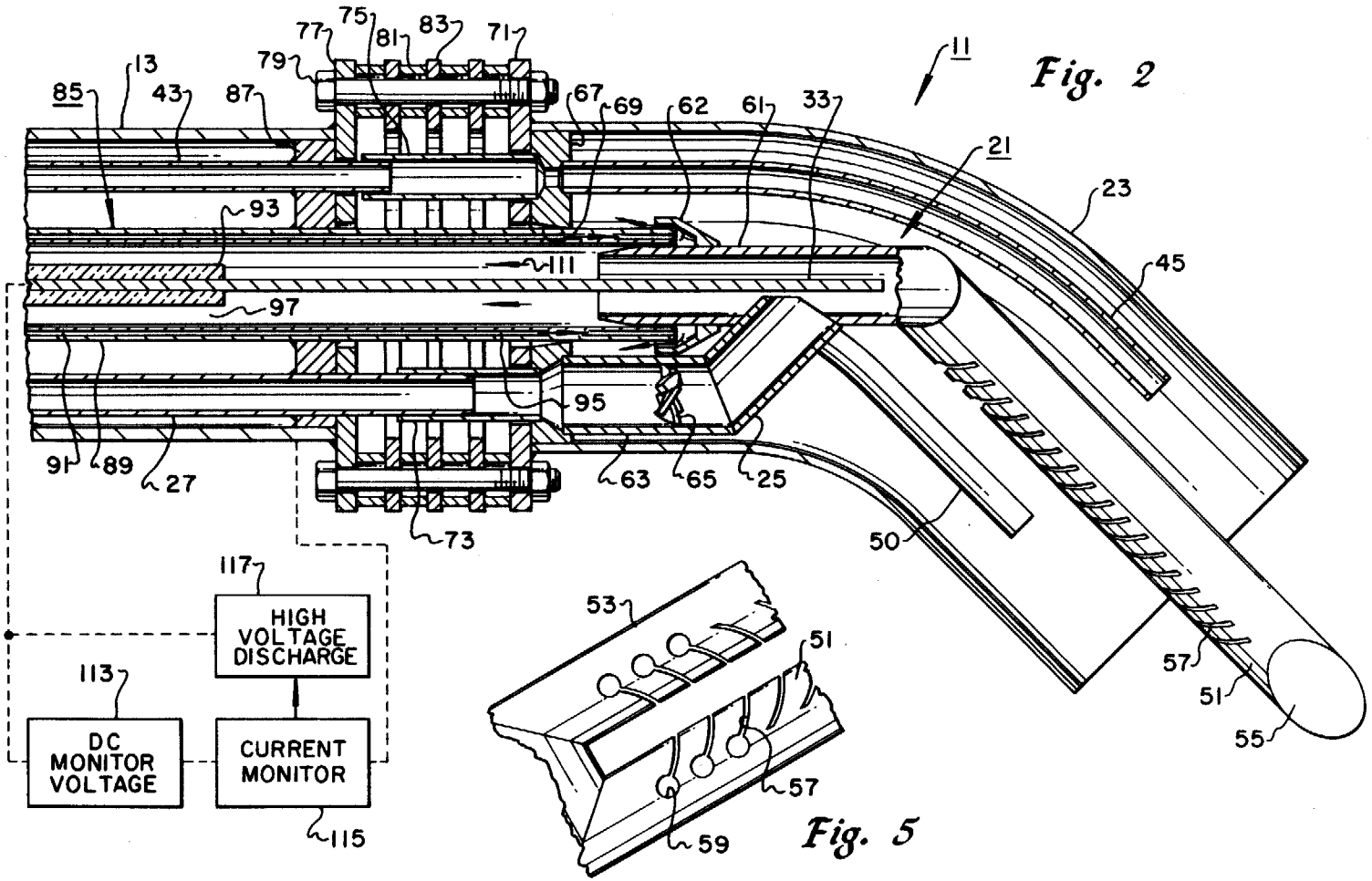
FIG. 2 is an enlarged sectional view of the upper end of the igniter FIG. 1.
FIG. 5 is a bottom view of the nozzle tips of the igniter of FIG. 1.

Nozzle assembly 21 has two laterally extending tips 51 and 53. These tips extend at an acute angle from the axis of the housing 13, for discharging the flame across the open end of the gas discharge pipe 19. Referring to FIG. 2, each tip 51 and 53 has a closed end 55. A plurality of slots 57 are cut along the lengths of the tips 51 and 53. The slots are elongated, in that each is long and narrow, with parallel sidewalls. The slots do not extend fully around the tips 51 and 53, and are located generally on sides that face each other, as shown in FIG. 5. Also, as shown in FIG. 5, the three lowermost slots each have a circular aperture 59 located on the lower side. The circular aperture 59 is located at an end, and provides a greater opening area for these slots than the other slots. These three slots allow the flame to escape at this point when the nozzle 21 is cold. When hot, flame will escape from all of the slots 57. The lower slots are fully shrouded by the shield 23 to prevent the flame from being extinguished by wind or rain.

Referring again to FIG. 2, the nozzle assembly 21 has a central conduit 61 that extends downwardly from the junction of the two tips 51 and 53. The central conduit 61 is located on the axis of the housing 11 and is a straight tubular member. A collar 62 surrounds the central conduit 61 a selected distance above the lower end of central conduit 61, which is open.

The main gas conduit 25 joins the central conduit 61 at an acute angle, and at the point where the central conduit 61 joins the two tips 51 and 53. A swirling device 65 is located in a portion 63 of main gas conduit 25 immediately downward therefrom. The portion 63 is parallel with the axis of housing 13 and is secured by welding or otherwise to a plate 67 at the lower end of the nozzle assembly 21. Plate 67 is circular and fits closely within the lower end of the shield 23. An axial aperture 69 is located in the center of plate 67. The forward ends 41, 45 and 50 of the auxillary lines are secured by welding or otherwise to plate 67. Plate 67 is connected by bolts (not shown) to a flange 71, which is welded to the shield 23. A conduit extension 73 extends downwardly from the plate 67 from the main gas conduit portion 63. There are also conduit extensions 75 for each of the auxillary line ends 41, 45 and 50 of lines 39, 43 and 49. Lines 39 and 49 are not shown in FIGS. 2 and 3. The nozzle assembly 21 thus includes integrally with it the plate 67, main gas conduit 25, auxillary conduit ends 41, 45 and 50, and the conduit extensions 73 and 75. This entire assembly bolts into the shield 23.

The shield 23 is bolted to a flange 77 which is welded to the upper end of the lower portion of housing 13. Bolts 79 extend between the flanges 71 and 77. Spacers 81 provide desired spacing between flanges 71 and 77. A number annular rings or fins 83 extend between the spacers 81. This area is open to atmosphere to reduce the transmission of heat from the shield 23 to the housing 13.

The frame assembly 85 has an upper plate 87 which abuts the flange 77, with flange 77 serving as a stop member to prevent the further upward travel of the frame assembly 85 in the housing 11. The gas lines, including the main gas line 27, and the auxillary lines 39, 43 and 49 all are welded to the plate 87, and extend forwardly a short distance for telescoping insertion into the conduit extensions 73 and 75. Flange 77 has holes through it to allow the passage of the lines 27, 39, 43 and 49. The frame assembly includes a pair of tubes 89 and 91 located on the axis of housing 13. The outer tube 89 is welded to the end plate 87 and has a forward portion that extends upwardly through aperture 69 and around the central conduit 61. The upper end of the outer tube 89 terminates within the collar 62, but does not form sealing contact with either the collar 62 or the central conduit 61. The inner tube 91 is of a diameter selected to provide an annular clearance 95 between the two tubes 89 and 91. The electrode 33 is encased within an insulating sheath 93. Sheath 93 is of a smaller outer diameter than the inner diameter of the inner tube 91, providing an inner annular passage 97. The upper end of inner tube 91 is substantionally flush with the upper end of the outer tube 89 and is also open for discharging circulated gas from the annular passage 95 between tubes 89 and 91. Inner tube 91 fits closely around central conduit 61.

Figure 3:
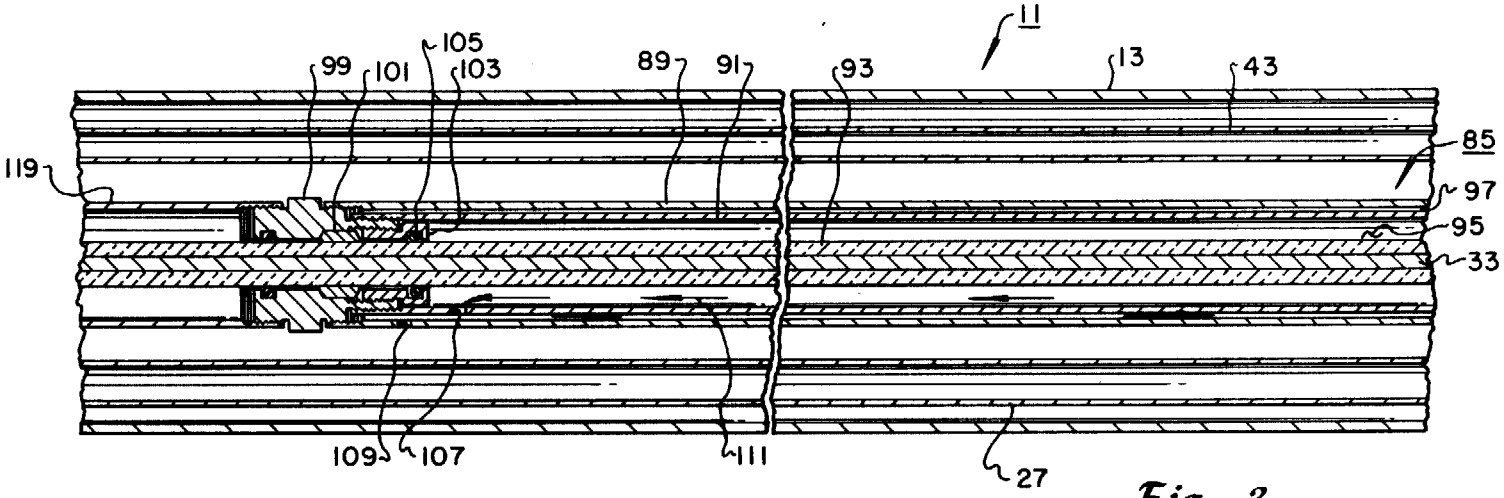
FIG. 3 is an enlarged sectional view of an intermediate portion of the igniter FIG. 1.

Referring to FIG. 3, the inner and outer tubes 89 and 91 are held in place by a retainer 99 located about 30 inches from the tip of electrode 33. Retainer 99 is a threaded member, having threads for receiving the outer tube 89, and lesser diameter threads for receiving the threads of the inner tube 91. A bushing 101 fits within the retainer for compressing against the insulating sheath 93. A retaining ring 103 screws into internal threads located in the retainer 99 for compressing the bushing 101 to tightly clamp the insulating sheath 93 in place. O-rings 105 located between the sheath 93 and the retainer 99, provide sealing to prevent leakage of any fluid below the retainer 99.

A plurality of holes 107 (only one shown) are formed in the inner tube 91 a short distance above the retaining ring 103. Holes 107 serve as communication means for communicating the inner and outer annular passsages 95 and 97. There is a single hole 109 formed in the outer tube 89 near retainer 99. Its purpose, however, is to allow the drainage of any liquid that might find its way into the passages 95 and 97 due to heavy rain, and not to allow circulation of any gas. Its opening area is much less than the combined opening areas of the holes 107.

Referring to FIGS. 2 and 3, as indicated by arrows 111, some of the hot gas from the vicinity of the tip of electrode 33 will flow down the inner annular passage 97, through the holes 107, and back up the outer annular passage 95. The gas will flow through the clearance between the outer tube 89 and the central conduit 61, and the clearance between outer tube 89 and the collar 62. The gas then discharges to atmosphere within the shield 23. The pressure difference between the nozzle 21 and the retainer 99 vicinity provides for this circulation. The pressure at nozzle 21 is slightly lower than near retainer 99. The circulation of the hot dry gas removes moisture from this vicinity, which otherwise could influence the indication of flame presence.

Referring still to FIG. 2, a DC monitor voltage source 113 located outside of housing 13 is continuously applied to electrode 33. This voltage, which is approximately 180 volts DC in the preferred embodiment, is connected between the housing 13 and the electrode 33. A current monitor 115 located external of housing 13 monitors if any current is present. Since electrode 33 is not grounded, there normally would be no current, so long as the atmosphere surrounding the electrode 33 isn't too humid. The current monitor 115 is connected to a high voltage discharge control 117, which controls the piezoelectric power source 35 ( FIG. 1). If no current is monitored, then the current monitor 115 signals the high voltage discharge control 117 to provide a very high voltage to the electrode 33, causing an arc or spark to occur at the tip. Once the combustion occurs, ionization of the atmosphere surrounding the tip 33 causes a current to flow due to the DC monitor voltage source 113. The presence of current detected by the current monitor 115 prevents the periodic discharge from the high voltage discharge control 117. The components in the high voltage discharge 117 control, monitor voltage source 113 and current monitor 115 are conventional.

Figure 4:
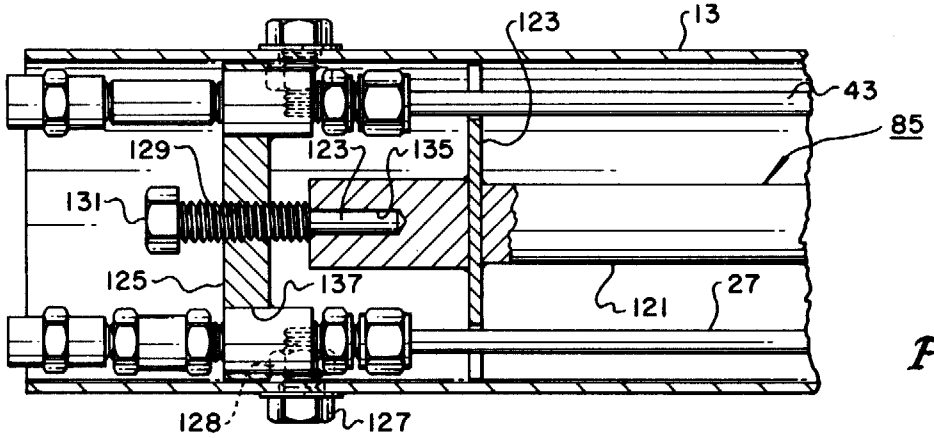
FIG. 4 is an enlarged sectional view of the lower portion of the igniter of FIG. 1.

Referring again to FIG. 3, the frame 85 is made up of a number of rigid members, including outer tube 89 and a tube 119 which extends downwardly from retainer 99. Tube 119 joins the piezoelectric power source 35 (FIG. 1). Referring to FIG. 4, a solid rod 121 is connected to the lower end of the power source 35 (FIG. 1) and extends downwardly to near the bottom of the housing 13. Rod 121 is held on the axis of the housing 13 by a centralizing plate 123. A brace 125, which is a flat plate in this embodiment, is located a short distance below the lower end of the rod 121. Brace 125 is held in place by two bolts 127, each of which extends through an aperture in the sidewall of housing 13. Each bolt 127 engages a nut 128 which is welded to the brace 125. The bolts 127 thus rigidly secure the brace 125 in place.

Brace 125 has a threaded aperture 129 on its axis, which is common with the axis of housing 13. A bolt 131 is adapted to engage the threaded aperture 129. Bolt 131 has a forward shank 133 which extends into a hole 135 in the lower end of the rod 121. Brace 125 and bolt 131 serve as locking means for pressing the frame 85 upwardly into tight contact with the flange 77 (FIG. 2). Brace 125 has a plurality of holes 137 for the connection of the lines 39, 43, 49 and 27 (FIG. 1).

In operation, igniter 11 is mounted to a discharge pipe 19. The main gas conduit 25 is connected to a fuel source 29. The auxillary line 49 is also connected to this fuel source 29. In some instances, low volume waste gas 47 will be connected to an auxillary line 43. Also, extinguishing fluid from a source 42 may be connected to one of the auxillary lines, such as auxillary line 39. Electrical power is supplied to the power source 35. A continuous DC voltage will be present on the electrode 33 (FIG. 2). The current monitor 115 will indicate the lack of current, and thus the lack of a flame, signalling the high voltage discharge control 117 to provide high voltage to the electrode 33 of aproximately 15,000 volts. This creates a spark, igniting the gas flowing through the main gas conduit 25. The flame discharges out the lower slots 57, discharging across the gas discharge pipe 19 for igniting the waste gas. Some waste gas may be discharged through the igniter for burning through the auxillary line 43. The current monitor 115 will sense a current flow due to the ionization taking place in the vicinity of electrode 33 and thus will not signal the high voltage discharge control 117. To prevent moisture build up, combustion gas will flow down the inner annular passage 97, returning up the outer annular passage 95.

Should it be necessary to remove the components for maintenance, bolts 127 are removed to allow brace 125 to be pulled out the lower end. The frame 85 is pulled out of housing 13, including the electrode 33. This leaves only the nozzle 21 within the shield 23. After maintenance, the assembly is pushed back into the housing 13. The frame 85 will stop upward movement once it contacts flange 77. The conduits 27, 39, 43 and 49 will slide into the conduit extensions 73 and 75. The outer tube 89 will slide around the central conduit 61. Bolts 127 are tightened. Then bolt 131 is tightened to push the rod 128 upward to tighten the frame 85 against the flange 77.

The invention has significant advantages. Providing a continuous DC voltage on the electrode allows current to be monitored to indicate the presense of a flame. Circulating hot combustion gases around the electrode from the retainer onward removes moisture, which could otherwise falsely indicate the presence of a flame. Mounting the components on a frame, which is secured by a locking device only at the bottom, allows the components to be easily removed for maintenance. The enlarged slot areas near the bottom of the nozzle tips facilitate the discharge of flame and are positioned so as to reduce the chance for the flame to be extinguished due to wind. Using the igniter auxillary lines for extinguishing fluid and for leakage waste gas provides an efficient manner in which to handle these fluids.

Although the invention has been shown in only one of forms, it should be apparent to those skilled in the art that it is not so limited but is susceptable to various changes without departing the scope of the invention.

I claim:

1. In an igniter for a gas discharge pipe of a type having a tubular housing adapted to be mounted to the pipe, a fuel line extending into the housing for delivering gaseous fuel to a nozzle, the improvement comprising in combination:

an electrode adapted to be connected to a source of electrical energy and having a tip extending into the nozzle for creating a spark to ignite the fuel;

retaining means spaced from the nozzle for securing the electrode in the housing; and gas circulation means for circulating hot gas from the nozzle around the electrode from the tip to the vicinity of the retaining means, to remove moisture from the space surrounding the electrode between the tip and the retaining means.

2. The igniter according to claim 1, further including means for detecting the presence of a flame at the nozzle, comprising in combination:

means for supplying a monitoring voltage to the electrode; and means for measuring any current flow between the electrode tip and the housing in response to the monitoring voltage, the current flow indicating the presence of a flame.

3. The igniter according to claim 1 wherein the gas circulation means comprises:

an inner annular passage surrounding the electrode and extending from the retaining means to the nozzle;

an outer passage extending from the retaining means to the nozzle; and interconnecting passage means adjacent the retaining means, for interconnecting the inner and outer passsages, causing hot gas in the nozzle to flow through one of the passages, through the innerconnecting passage means, and back through the other passage to the nozzle.

4. In an igniter for gas discharge pipe of the type having a tubular housing adapted to be mounted to the pipe, a fuel line extending into the housing for delivering gaseous fuel to a nozzle, the improvement comprising in combination:

an electrode having a tip extending into the nozzle;

an insulating sheath extending around the electrode to a point a selected distance from the tip;

retaining means located in the housing in surrounding and sealing contact with the sheath for retaining the electrode in the housing;

an annular passage surrounding the sheath and the electrode from the retaining means to the nozzle;

circulating passage means connected to the annular passage near the retainer means and extending to the nozzle, for allowing hot gas in the nozzle to flow through the annular passage and circulating passage means to remove moisture from the space surrounding the electrode;

power means for supplying a high DC voltage discharge to the electrode to create a spark to ignite the fuel, and for supplying a lower monitoring voltage to the electrode; and means for measuring current flow between the electrode tip and the housing in response to the monitoring voltage, the current flow indicating the presence of a flame.

5. In an igniter for a gas discharge pipe of the type having a tubular housing adapted to be mounted to the pipe, a fuel line extending into the housing for delivering gaseous fuel to a nozzle, the improvement comprising in combination:

an electrode adapted to be connected to a source of electrical energy and having a tip extending into the nozzle for creating a spark to ignite the fuel;

an insulating sheath extending around the electrode from its base to a point a selected distance from the tip;

retaining means located in the housing in surrounding and sealing contact with the sheath for retaining the electrode in the housing;

an inner tube coupled to the retaining means and extending to a point adjacent the nozzle, the inner tube surrounding the sheath and electrode and being of greater diameter than the sheath, defining an inner annular passage; and an outer tube coupled to the retaining means and extending to a point adjacent the nozzle, the outer tube surrounding the inner tube and being of a greater diameter than the inner tube, defining an outer annular passage;

the inner tube having at least one hole located adjacent the retaining means, communicating the inner and outer passages with each other to allow hot gas in the nozzle to circulate through the inner and outer annular passages to remove moisture.

6. The igniter according to claim 5 wherein the nozzle is a tubular member having a plurality of slits for the discharge of flame and located within a tubular shield mounted to the discharge end of the housing and sealed therefrom, the outer passage communicating with the atmosphere in the shield to allow hot gas circulated through the annular passages to be discharged into the shield surrrounding the nozzle.

* * * * *

UNITED STATES PATENT AND TRADEMARK OFFICE

CERTIFICATE OF CORRECTION

PATENT NO. : 4,595,354

DATED : June 17, 1986

INVENTOR(S) : Romeo E. Guerra

It is certified that error appears in the above-identified patent and that said Letters Patent is hereby corrected as shown below:

Column 1, Line 11, "wasted" is changed to--waste--;

Column 1, Line 23, "interuption" is changed to--interruption--;

Column 1, Line 32, "for" is deleted;

Column 1, Line 62, "present" is changed to--presence--;

Column 3, Line 26, "mozzle" is changed to--nozzle--;

Column 4, Line 14, "number annular" is changed to--number of annular--;

Column 4, Line 21, "11" is changed to--13--;

Signed and Sealed this

Twenty-eighth Day of June, 1988

*Attest:*

*Attesting Officer*

DONALD J. QUIGG

*Commissioner of Patents and Trademarks*